US006354592B1

(12) United States Patent
Virzi

(10) Patent No.: US 6,354,592 B1
(45) Date of Patent: Mar. 12, 2002

(54) PYRAMID STRUCTURED GAMING TOURNAMENT

(76) Inventor: Thomas M. Virzi, 360 Rushing Creek Ct., Henderson, NV (US) 89014

( * ) Notice: Subject to any disclaimer, the term of this patent is extended or adjusted under 35 U.S.C. 154(b) by 0 days.

(21) Appl. No.: 09/680,029

(22) Filed: Oct. 10, 2000

(51) Int. Cl.[7] ..... A63B 71/00

(52) U.S. Cl. ..... 273/138.1; 273/143 R; 463/13; 463/16; 463/17

(58) Field of Search ..... 273/138.1, 143 R; 463/13, 16, 17

(56) References Cited

U.S. PATENT DOCUMENTS 5,967,514 A * 10/1999 Kelly et al. ..... 273/138.1
6,015,345 A * 1/2000 Kail ..... 463/16
6,017,032 A * 1/2000 Grippo et al. ..... 273/138.1
6,032,955 A * 3/2000 Luciano et al. ..... 273/138.1
6,039,648 A * 3/2000 Guinn et al. ..... 463/13
6,092,806 A * 7/2000 Follis ..... 273/138.1
6,102,797 A * 8/2000 Kail ..... 463/16
6,210,275 B1 * 4/2001 Olsen ..... 463/16
6,224,482 B1 * 5/2001 Bennett ..... 463/20

* cited by examiner

*Primary Examiner*—Benjamin H. Layno
*Assistant Examiner*—D Collins
(74) *Attorney, Agent, or Firm*—Leonard Weiss

(57) ABSTRACT

Every hour, two hundred players who pay a five dollar entry fee into a pool receive a known number of chips that are risked during forty five minutes of play in an entry level game of a tournament. Of money in the pool, four hundred fifty dollars is paid into a pyramid fund, four hundred fifty dollars is paid to a winner the entry level game and one hundred dollars is paid to a tournament host. At the end of each week of a four week interval, there are 168 entry level game winners who have an opportunity to compete in a second level game of the tournament. At the end of each four weeks of a forty eight week interval, there are four second level game winners who have an opportunity to compete in a third level game. Winners of the second and third level games receive payouts from the pyramid fund. Winners of the third level games compete in a championship game of the tournament for all remaining money in the pyramid fund.

7 Claims, 2 Drawing Sheets

PYRAMID STRUCTURED GAMING TOURNAMENT

BACKGROUND OF THE INVENTION

1. Field of Invention

This invention is in the general field of gaming and, more particularly, is a gaming tournament with a hierarchal structure.

2. Description of the Prior Art

To be successful, a casino's property must be marketed to gamblers willing to spend their time and money at the casino. A widely used marketing strategy is to position the casino as a host to a gaming tournament, such as a blackjack, a poker or a slot machine tournament.

Participation in the tournament is conditioned upon payment of an entry fee into a pool from which a payout of a prize is made to a tournament winner. People who pay the entry fee are likely to have money to spend in the casino.

There are tournaments where the payout is in excess of a million dollars. A limitation of the one million dollar payout tournament is that the entry fee is frequently on the order of thousands of dollars. The one million dollar payout tournament is rare because the entry fee limits participation to the wealthiest players. Therefore, there is a need for a high payout tournament where a participant pays a generally affordable entry fee.

The high payout tournament with the generally affordable entry fee can be accomplished by having an increased number of tournament participants. Heretofore, there has not been a large payout tournament with the generally affordable entry fee.

SUMMARY OF THE INVENTION

An object of the present invention is a gaming tournament structured to have many participants.

Another object of the present invention is a gaming tournament structured to have multiple winners.

Another object of the present invention is a gaming tournament structured to provide a high payout to a winner.

Another object of the present invention is a high payout gaming tournament having a generally affordable entry fee.

According to the present invention, periodically, players pay an entry fee to compete in an entry level game of a tournament during a play period. At the end of the play period, a percentage of the entry fees is paid to a winner of the entry level game and a percentage of the entry fees is paid into a progressive account called a pyramid fund. The entry level game winner is given an opportunity to compete in a second level game of the tournament against other entry level game winners. A winner of the second level game receives a percentage of the pyramid fund and an opportunity to compete in a higher level game of the tournament against other second level game winners.

Other objects, features, and advantages of the invention should be apparent from the following description of the preferred embodiment thereof as illustrated in the accompanying drawing.

DESCRIPTION OF THE PREFERRED EMBODIMENT

The invention is a hierarchal gaming tournament where a relatively high payout to a few players is funded by a relatively small entry fee paid by many players. The invention is applicable to many types of games, such as blackjack, slot machines, craps, poker and bingo.

In this embodiment, every hour two hundred players pay a five dollar entry fee into a pool to compete in an entry level game of a blackjack tournament thereby providing one thousand dollars per hour into the pool. One hundred dollars from the pool is paid to a tournament host, thereby leaving a resource level of nine hundred dollars for the tournament.

The entry level players are each given an equal number of chips prior to a forty five minute period of play during which they risk their chips playing blackjack. At the end of the play period, an entry level player with the most chips is declared a winner. An administrative period of fifteen minutes is allotted for seating of the entry level players and distributing the chips. Therefore, an entry level time interval of one hour is allotted for the entry level game.

Figure 1:
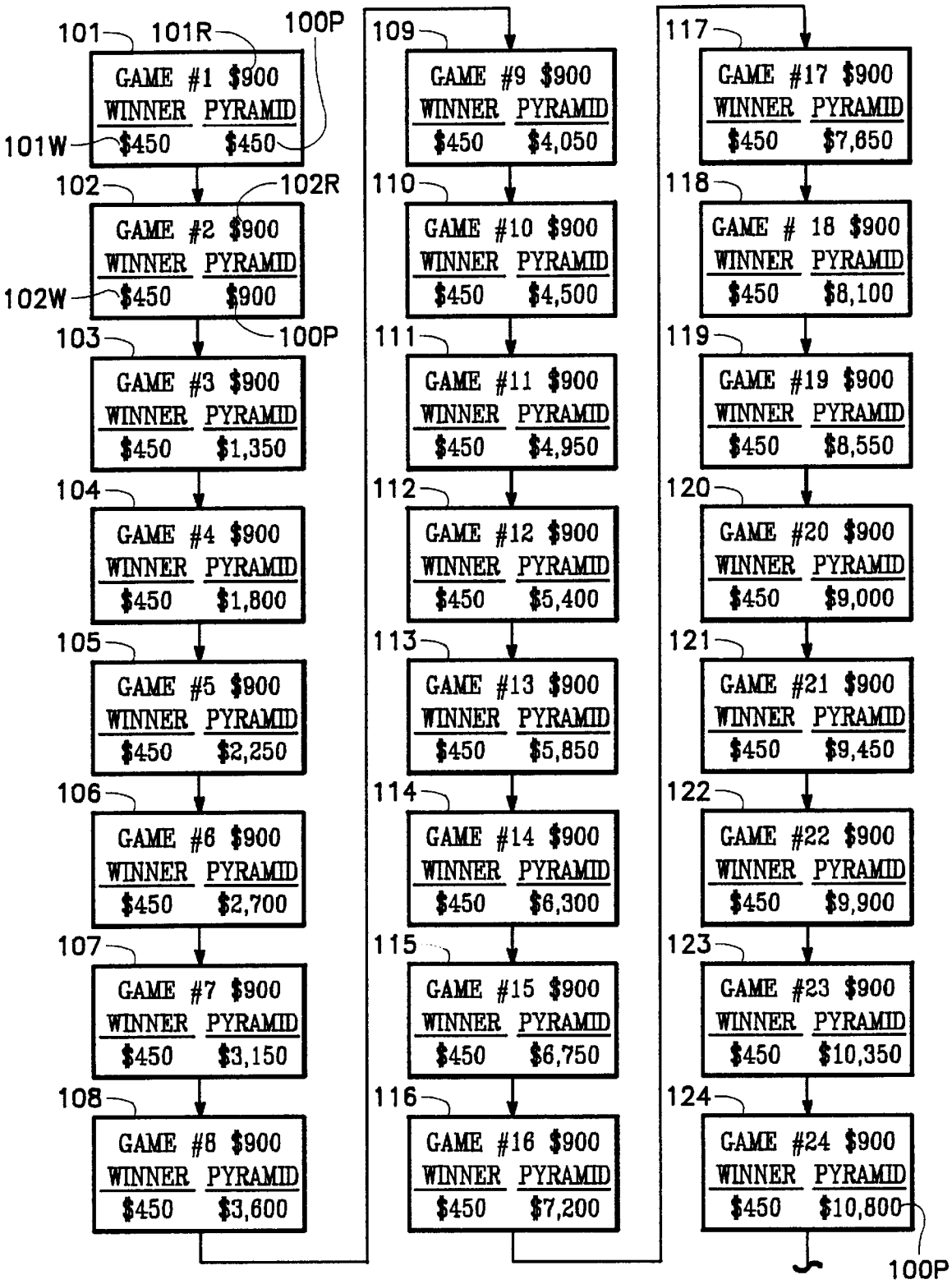
FIG. 1 is a showing of disbursements of fees paid to play in entry level games of a tournament during a twenty four hour interval.

As shown in FIG. 1, an entry level game 101 has a resource level 101R of nine hundred dollars as described hereinbefore. Of the nine hundred dollars, a sum 101W, of four hundred fifty dollars, is paid to a winner of the game 101 and a sum of four hundred fifty dollars is held in a pyramid fund 100P.

Immediately after completion of the game 101, a second entry level game 102 starts with a resource level 102R that equals the resource level 101R. Additionally, a sum 102W, equal to the sum 101W, is paid to a winner of the game 102. The sum of four hundred fifty dollars is paid into the pyramid fund 100P whereby nine hundred dollars is in the pyramid fund 100P.

In a similar manner, entry level games 103–124 are completed. Accordingly, the completion of the games 101–124 takes twenty four hours, thereby accumulating ten thousand eight hundred dollars in the pyramid fund 100P. Since each of the games 101–124 has a winner, there are twenty four entry level game winners who are each paid four hundred fifty dollars.

At the end of one week, a $1^{st}$ entry level conclusion sum of $75,600 (which is $10,800×7 days) is held in the pyramid fund 100P and there are 168 entry level game winners. It should be understood that entry level games continue substantially throughout the tournament, thereby paying the entry level conclusion sum of $75,600 each week into the pyramid fund 100P.

Once per week, during a four week interval four groups of 168 entry level game winners each compete in a weekly second level game of the tournament. Accordingly, there are four second level games.

Figure 2:
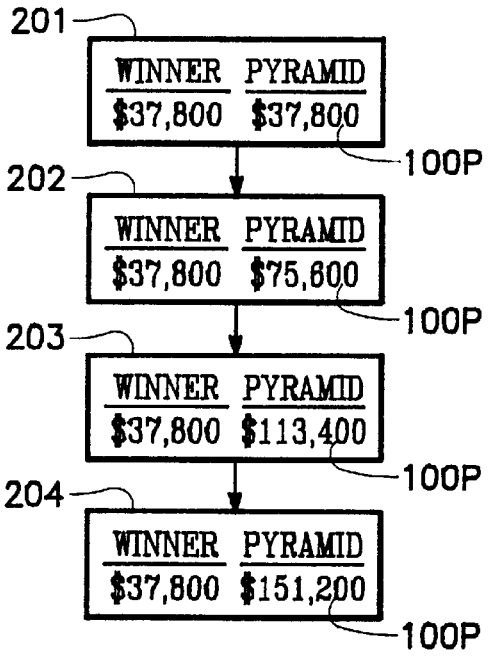
FIG. 2 is a showing of the status of a pyramid fund and prize money paid to winners of four second level games of the tournament that are played during a four week interval.

As shown in FIG. 2, a first of the four groups of 168 entry level game winners compete in a second level game 201 immediately after the $1^{st}$ entry level conclusion sum ($75,600) has been paid into the pyramid fund 100P. One half of the $1^{st}$ entry level conclusion sum ($37,800) is paid to a winner of the game 201 thereby leaving a holding of $37,800 in the pyramid fund 100P.

One week after a start of the game 201, a second of the four groups of 168 entry level game winners compete in a second level game 202 immediately after a $2^{nd}$ entry level conclusion sum of $75,600 has been paid into the pyramid fund 100P. One half of the $2^{nd}$ entry level conclusion sum ($37,800) is paid to a winner of the game 202, leaving a holding of $75,600 in the pyramid fund 100P.

Correspondingly, two weeks after the start of the game 201, a third of the four groups of 168 entry level game winners compete in a second level game 203. Three weeks after the start of the game 201, a fourth of the four groups of 168 entry level game winners compete in a second level game 204. Like winners of the games 201, 202, winners of the games 203, 204 are each paid $37,400. After the game 204, a $1^{st}$ second level conclusion sum of $151,200 is held in the pyramid fund 100P.

Preferably, the entry level game winners enter the games 201–204 with chips equal in number to chips in their possession at the completion of the entry level game that they won. Alternatively, the entry level game winners enter the games 201–204 with a predetermined number of chips. A second level time interval, that includes a second level play period of two hours, is allotted for each of the games 201–204.

A second level winner of the game 201, for example, is a player with the most chips at the end of a second level play period of the game 201. Second level game winners of the games 202–204 are determined in a similar manner Once every four weeks during a forty eight week interval, twelve groups of four second level game winners compete in a third level game of the tournament. Accordingly, there are twelve third level games. The twelve groups are hereinafter individually referred to as groups one through twelve.

Figure 3:
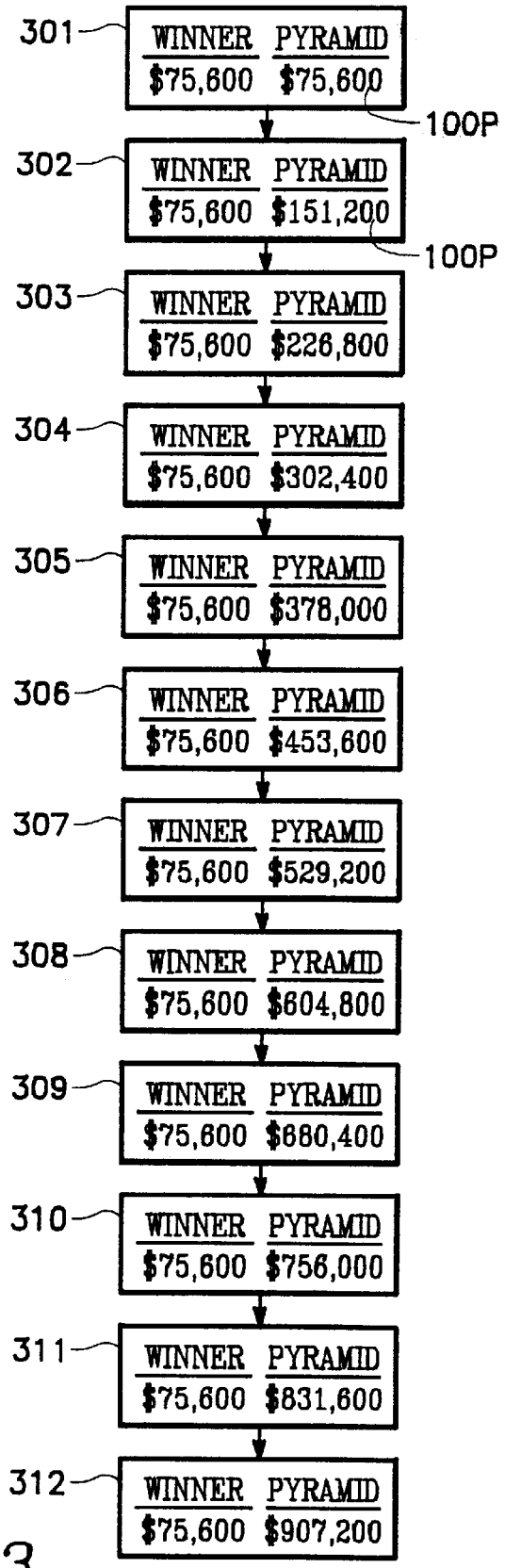
FIG. 3 is a showing of the status of the pyramid fund and prize money paid to winners of twelve third level games of the tournament that are played during a forty eight week interval.

As shown in FIG. 3, group one of the twelve groups compete in a third level game 301 immediately after the $1^{st}$ second level conclusion sum of $151,200 has been paid into the pyramid fund 100P. One half of the $1^{st}$ second level conclusion sum ($75,600) is paid to a winner of the game 301 thereby leaving a holding of $75,600 in the pyramid fund 100P.

Four weeks after a start of the game 301, group two of the twelve groups compete in a third level game 302 immediately after a $2^{nd}$ second level conclusion sum of $151,200 has been paid into the pyramid fund 100P. One half of the second $2^{nd}$ second level conclusion sum ($75,600) is paid to a winner of the game 301 thereby leaving a holding of $151,200 in the pyramid fund 100P.

Correspondingly, groups three through twelve compete in third level games 303–312, respectively, with the games 303–312 being played sequentially. At the conclusion of the game 312, a $3^{rd}$ level conclusion sum of $907,200 is held in the pyramid fund 100P.

Preferably, the second level winners enter the games 301–312 with chips equal in number to chips in their possession at the completion of the second level game that they won. Alternatively, the second level game winners enter the games 301–312 with a predetermined number of chips. A third level time interval, that includes a third level play period of three hours, is allotted for each of the games 301–312.

A third level game winner of the game 301, for example, is a player with the most chips at the end of a third level play period of the game 301. Third level game winners of the games 302–312 are determined in a similar manner. After the game 312, there is a championship game of the tournament where winners of the games 301–312 compete for the $907,200.

While the invention has been particularly shown and described with reference to a preferred embodiment thereof, it should be understood by those skilled in the art that changes in form and detail may be made therein without departing from the spirit and scope of the invention.

I claim:

1. In the method of structuring a hierarchal gaming tournament, comprising the steps of:

periodically providing a plurality of players who pay an entry fee into a pool to compete in an entry level game of the tournament, a percentage of said pool being a resource level of the tournament;

paying a percentage of the resource level into a pyramid fund;

determining winners of entry level games;

making a payout of a percentage of said resource level to entry level game winners;

providing an opportunity to said entry level game winners to compete in a higher level game of the tournament; and making a payout of a portion of said pyramid fund to a winner of said higher level game.

2. The method of claim 1, including the additional step of paying a percentage of the pool to a tournament host.

3. The method of claim 1 wherein the step of periodically providing includes the additional steps of:

allotting an entry level time interval for said entry level game, said entry level time interval including a play period; and giving each player an equal number of chips that are risked during said play period.

4. The method of claim 3 wherein said step of determining includes declaring the player with the most chips at the end of the play period a winner.

5. In the method of claim 3 wherein said entry level game winners enter said higher level game with chips equal in number to chips in their posession at the completion of the entry level game that they won.

6. In the method of claim 5, the additional step of alloting a higher level time limit for said higher level game, said higher level time limit including a play period.

7. In the method of claim 1 wherein said higher level game starts after a conclusion sum has been paid into the pyramid fund.

* * * * *